US006058545A

United States Patent [19]

Roach

[11] Patent Number: 6,058,545

[45] Date of Patent: May 9, 2000

[54] BODY SCRUBBING DEVICE

[76] Inventor: Floy Zell Roach, 12404 Ferris Ave., Cleveland, Ohio 44105

[21] Appl. No.: 09/105,433

[22] Filed: Jun. 26, 1998

[51] Int. Cl.[7] ..... A47L 1/05

[52] U.S. Cl. ..... 15/97.1; 15/21.1; 15/23

[58] Field of Search ..... 15/21.1, 23, 34, 15/97.1, 97.2, 50.3, 53.2, 52.1, 103.5, 110, 230, 230.11, 98; 601/118, 119, 136, 137, 138

[56] References Cited

U.S. PATENT DOCUMENTS

| | | |
|---|---|---|
| 164,547 | 6/1875 | Grant . |
| 1,675,225 | 6/1928 | Moratta . |
| 2,658,217 | 11/1953 | Green . |
| 3,158,887 | 12/1964 | Kanbar et al. . |
| 3,316,577 | 5/1967 | Kravos . |
| 3,368,231 | 2/1968 | Kravos et al. . |
| 4,417,362 | 11/1983 | Walker . |
| 5,554,102 | 9/1996 | Chiou . |
| 5,558,625 | 9/1996 | McKay . |

*Primary Examiner*—Robert J. Warden, Sr.
*Assistant Examiner*—Jennifer McNeil

[57] ABSTRACT

A body scrubbing device for scrubbing and massaging the back and lower body of a user. The device includes a generally U-shaped housing having a spaced apart pair of arm portions and a main portion connecting the arm portions of the housing together. A scrubbing member is positioned between the arm portions of the housing. The scrubbing member has opposite first and second ends and a longitudinal axis extending between the first and second ends of the scrubbing member. The first end of the scrubbing member is rotatably mounted to a first of the arm portions of the housing and the second end of the scrubbing member is rotatably mounted to a second of the arm portions of the housing. A motor for rotating the scrubbing member about the longitudinal axis of the scrubbing member is provided in the interior space of the housing.

8 Claims, 2 Drawing Sheets

BODY SCRUBBING DEVICE

BACKGROUND OF THE INVENTION

1. Field of the Invention

The present invention relates to back scrubbing devices and more particularly pertains to a new body scrubbing device for scrubbing and massaging the back and lower body of a user.

2. Description of the Prior Art

The use of back scrubbing devices is known in the prior art. More specifically, back scrubbing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art back scrubbing devices include U.S. Pat. Nos. 4,040,132; 5,345,640; 5,450,647; 5,239,712; 4,696,068; 3,612,044; and U.S. Pat. No. 4,417,362.

While these devices fulfill their respective, particular objectives and requirements, the aforementioned patents do not disclose a new body scrubbing device. The inventive device includes a generally U-shaped housing having a spaced apart pair of arm portions and a main portion connecting the arm portions of the housing together. A scrubbing member is positioned between the arm portions of the housing. The scrubbing member has opposite first and second ends and a longitudinal axis extending between the first and second ends of the scrubbing member. The first end of the scrubbing member is rotatably mounted to a first of the arm portions of the housing and the second end of the scrubbing member is rotatably mounted to a second of the arm portions of the housing. A motor for rotating the scrubbing member about the longitudinal axis of the scrubbing member is provided in the interior space of the housing.

In these respects, the body scrubbing device according to the present invention substantially departs from the conventional concepts and designs of the prior art, and in so doing provides an apparatus primarily developed for the purpose of scrubbing and massaging the back and lower body of a user.

SUMMARY OF THE INVENTION

In view of the foregoing disadvantages inherent in the known types of back scrubbing devices now present in the prior art, the present invention provides a new body scrubbing device construction wherein the same can be utilized for scrubbing and massaging the back and lower body of a user.

The general purpose of the present invention, which will be described subsequently in greater detail, is to provide a new body scrubbing device apparatus and method which has many of the advantages of the back scrubbing devices mentioned heretofore and many novel features that result in a new body scrubbing device which is not anticipated, rendered obvious, suggested, or even implied by any of the prior art back scrubbing devices, either alone or in any combination thereof.

To attain this, the present invention generally comprises a generally U-shaped housing having a spaced apart pair of arm portions and a main portion connecting the arm portions of the housing together. A scrubbing member is positioned between the arm portions of the housing. The scrubbing member has opposite first and second ends and a longitudinal axis extending between the first and second ends of the scrubbing member. The first end of the scrubbing member is rotatably mounted to a first of the arm portions of the housing and the second end of the scrubbing member is rotatably mounted to a second of the arm portions of the housing. A motor for rotating the scrubbing member about the longitudinal axis of the scrubbing member is provided in the interior space of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new body scrubbing device apparatus and method which has many of the advantages of the back scrubbing devices mentioned heretofore and many novel features that result in a new body scrubbing device which is not anticipated, rendered obvious, suggested, or even implied by any of the prior art back scrubbing devices, either alone or in any combination thereof.

It is another object of the present invention to provide a new body scrubbing device which may be easily and efficiently manufactured and marketed.

It is a further object of the present invention to provide a new body scrubbing device which is of a durable and reliable construction.

An even further object of the present invention is to provide a new body scrubbing device which is susceptible of a low cost of manufacture with regard to both materials and labor, and which accordingly is then susceptible of low prices of sale to the consuming public, thereby making such body scrubbing device economically available to the buying public.

Still yet another object of the present invention is to provide a new body scrubbing device which provides in the apparatuses and methods of the prior art some of the advantages thereof, while simultaneously overcoming some of the disadvantages normally associated therewith.

Still another object of the present invention is to provide a new body scrubbing device for scrubbing and massaging the back and lower body of a user.

Yet another object of the present invention is to provide a new body scrubbing device which includes a generally U-shaped housing having a spaced apart pair of arm portions and a main portion connecting the arm portions of the housing together. A scrubbing member is positioned between the arm portions of the housing. The scrubbing member has opposite first and second ends and a longitudinal axis extending between the first and second ends of the scrubbing member. The first end of the scrubbing member is rotatably mounted to a first of the arm portions of the housing and the second end of the scrubbing member is rotatably mounted to a second of the arm portions of the housing. A motor for rotating the scrubbing member about the longitudinal axis of the scrubbing member is provided in the interior space of the housing.

Still yet another object of the present invention is to provide a new body scrubbing device that provides a hands-free back scrub or massage for lower body parts.

Even still another object of the present invention is to provide a new body scrubbing device that can be detachably attached to a shower wall or the side of a tub.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
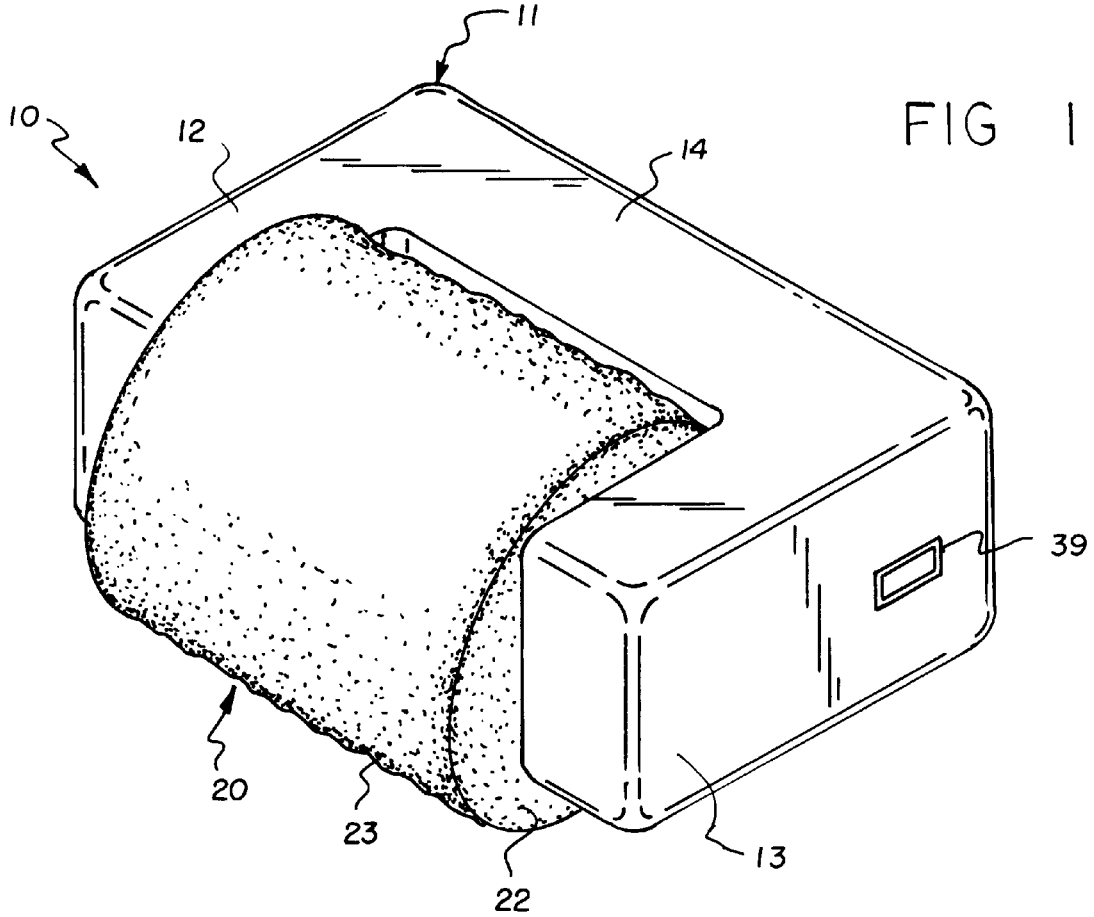
FIG. 1 is a schematic front perspective view of a new body scrubbing device according to the present invention.
Figure 2:
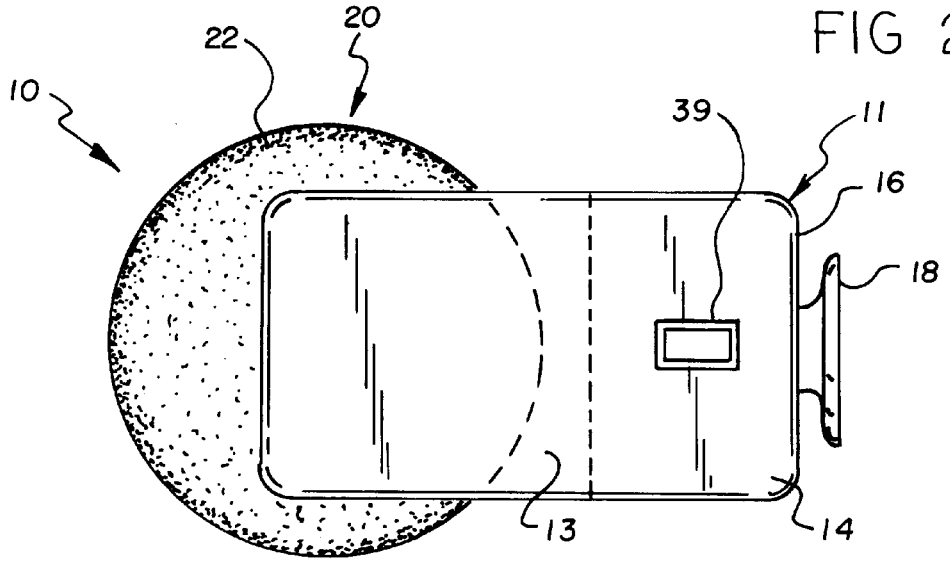
FIG. 2 is a schematic side view of the present invention.
Figure 3:
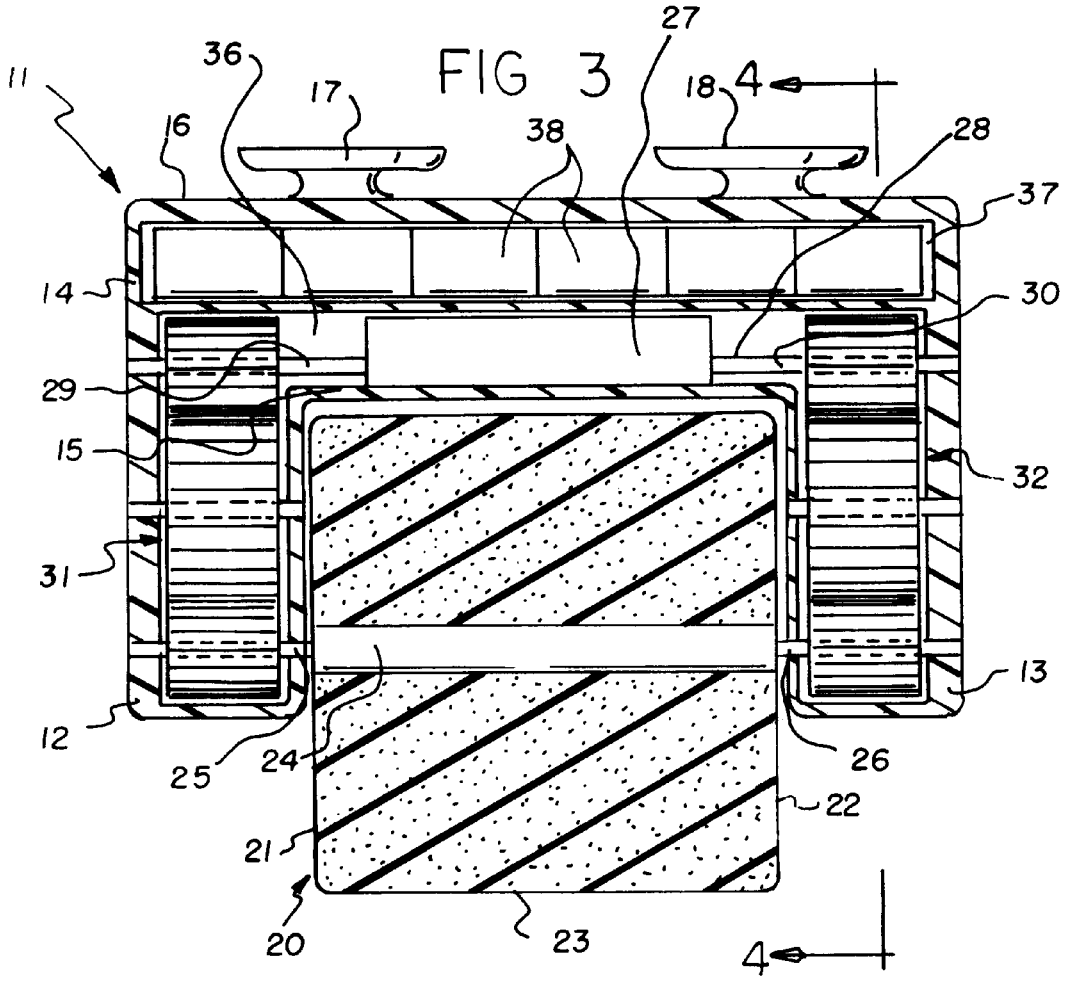
FIG. 3 is a schematic cross sectional view of the present invention.
Figure 4:
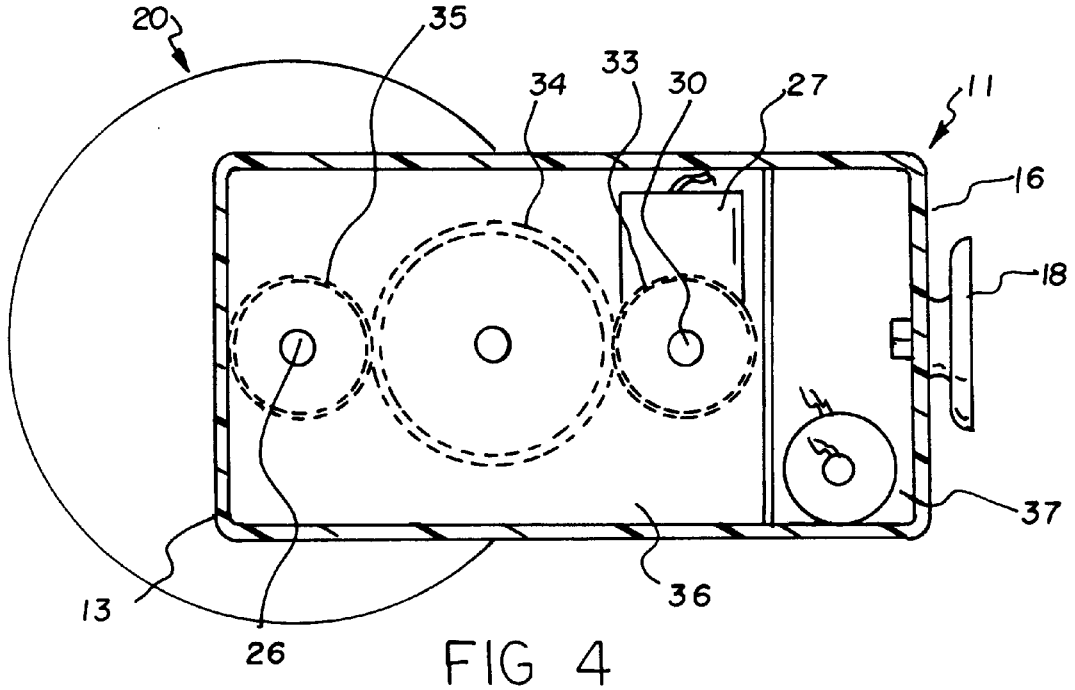
FIG. 4 is a schematic cross sectional view taken from line 4—4 of FIG. 3 of the present invention.

With reference now to the drawings, and in particular to FIGS. 1 through 4 thereof, a new body scrubbing device embodying the principles and concepts of the present invention and generally designated by the reference numeral 10 will be described.

As best illustrated in FIGS. 1 through 4, the body scrubbing device 10 generally comprises a generally U-shaped housing 11 having a spaced apart pair of arm portions 12,13 and a main portion 14 connecting the arm portions 12,13 of the housing 11 together. A scrubbing member 20 is positioned between the arm portions 12,13 of the housing 11. The scrubbing member 20 has opposite first and second ends 21,22 and a longitudinal axis extending between the first and second ends 21,22 of the scrubbing member 20. The first end 21 of the scrubbing member 20 is rotatably mounted to a first of the arm portions 12 of the housing 11 and the second end 22 of the scrubbing member 20 is rotatably mounted to a second of the arm portions 13 of the housing 11. A motor 27 for rotating the scrubbing member 20 about the longitudinal axis of the scrubbing member 20 is provided in the interior space of the housing 11.

In closer detail, the housing 11 is generally U-shaped and has an interior, a spaced apart pair of arm portions 12,13 and a main portion 14 connecting the arm portions 12,13 of the housing 11 together. Preferably, the arm portions 12,13 and the main portion each have a generally rectangular cross section. The main portion 14 of the housing 11 has a front 15 and a back 16. The arm portions 12,13 of the housing 11 are outwardly extended from the front 15 of the main portion 14. The back 16 of the main portion 14 is attachable to a surface such as a shower wall or a side of a tub. Preferably, the back 16 of the main portion 14 has a pair of spaced apart suction cups 17,18 provided thereon for detachably attaching the back 16 of the main portion 14 to the surface.

The scrubbing member 20 is positioned between the arm portions 12,13 of the housing 11. The scrubbing member 20 is generally cylindrical and has an outer scrubbing surface 23, generally circular opposite first and second ends 21,22, and a longitudinal axis extending between the first and second ends 21,22 of the scrubbing member 20. The outer scrubbing surface 23 of the scrubbing member 20 preferably has a rough surface to aid scrubbing therewith of the back 16 and body of a user. The first and second ends 21,22 of the scrubbing member 20 each have a center with the longitudinal axis of the scrubbing member 20 extending through the centers of the first and second ends 21,22 of the scrubbing member 20. The first end 21 of the scrubbing member 20 is rotatably mounted to a first of the arm portions 12 of the housing 11 while the second end 22 of the scrubbing member 20 is rotatably mounted to a second of the arm portions 13 of the housing 11. The first and second ends 21,22 of the scrubbing member 20 are preferably rotatably mounted to their associated arm portion of the housing 11 at their centers to permit free rotation of the scrubbing member 20 about the longitudinal axis of the scrubbing member 20.

Preferably, an elongate axle shaft 24 rotatably mounts the first and second ends 21,22 of the scrubbing member 20 to the arm portions 12,13 of the housing 11. The axle shaft 24 has a pair of opposite ends 25,26 and extends through the first and second ends 21,22 of the scrubbing member 20 along the longitudinal axis of the scrubbing member 20 such that one of the ends 25 of the axle shaft 24 extends from the first end 21 of the scrubbing member 20 and another 26 of the ends of the axle shaft 24 extends from the second end 22 of the scrubbing member 20. The one end 25 of the axle shaft 24 is extended into the first arm portion 12 of the housing 11 and the other end 26 of the axle shaft 24 is extended into the second arm portion 13 of the housing 11 to rotatably mount the scrubbing member 20 to the arm portions 12,13 to permit free rotation of the axle shaft 24 and the scrubbing member 20 about the longitudinal axis of the scrubbing member 20.

A motor 27 is provided in the interior of the housing 11 for rotating the scrubbing member 20 about the longitudinal axis of the scrubbing member 20. The motor 27 is preferably provided in the interior space of the housing 11 in a first compartment 36 in the main portion 14 of the housing 11. The motor 27 has a rotating shaft 28 which rotates when the motor 27 is energized. The rotating shaft 28 of the motor 27 has a pair of opposite ends 29,30. One of the ends 29 of the rotating shaft 28 of the motor 27 is extended in the interior space of the housing 11 in a direction towards the first arm portion 12 while the other end 30 of the rotating shaft 28 of the motor 27 extends in the interior space of the housing 11 in a direction towards the second arm portion 13 of the housing 11. A first set of gears 31 operatively connects the one end 29 of the rotating shaft 28 of the motor 27 to the one end 25 of the axle shaft 24 and a second set of gears 32 operatively connects the other end 30 of the rotating shaft 28 of the motor 27 to the other end 26 of the axle shaft 24. The first and second sets of gears operatively connect the rotating shaft 28 of the motor 27 to the axle shaft 24 such that rotation of the rotating shaft 28 by the motor 27 in turn rotates the axle shaft 24.

Preferably, the first and second sets of the gears 31,32 each comprises a primary gear 33, a rotation gear 34 and an axle gear 35. The primary gear 33 is attached to the associated end of the rotating shaft 28. The axle gear 35 is attached to the associated end of the axle shaft 24. The rotation gear 34 is interposed between the primary gear 33 and the axle gear 35 and engages both the primary gear 33 and the axle gear 35 such that rotation of one of the gears results in rotation of the other gears of the set of gears.

A power source is provided for powering the motor 27 is electrically connected to the motor 27. The power source preferably comprises a plurality of batteries 38 (ideally six D-size batteries) provided in a second compartment 37 in the interior of the housing 11 in the main portion 14 of the housing 11. A switch 39 provided on the exterior of the housing 11 and electrically connected to the motor 27 permits selective energization of the motor 27 by the user.

In an ideal illustrative embodiment, the housing 11 has a width defined between the arm portions 12,13 of the housing 11 of about 14.5 inches. In this illustrative embodiment, the housing 11 has a depth defined between the front 15 free terminuses of the arm portions 12,13 and the back 16 of the main portion 14 of about 9.5 inches. The arm portions 12,13 of the housing 11 are ideally spaced apart about 8.5 inches with each of the arm portions 12,13 having a width of about 3 inches. In this illustrative embodiment, each of the arm portions 12,13 has a length defined from the front 15 of the main portion 14 to their front 15 free terminus preferably of about 6.5 inches such that the main portion 14 has a width defined between the front 15 and back 16 of the main portion 14 of about 3 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body scrubbing device, comprising:

a housing being generally U-shaped and having an interior, a spaced apart pair of arm portions and a main portion connecting said arm portions of said housing together;

said main portion of said housing having a front and a back, said arm portions of said housing being outwardly extended from said front of said main portion;

said back of said main portion being attachable to a surface;

a scrubbing member being positioned between said arm portions of said housing;

said scrubbing member having opposite first and second ends and a longitudinal axis extending between said first and second ends of said scrubbing member;

said first end of said scrubbing member being rotatably mounted to a first of said arm portions of said housing, said second end of said scrubbing member being rotatably mounted to a second of said arm portions of said housing;

a motor for rotating said scrubbing member about said longitudinal axis of said scrubbing member, said motor being provided in said interior space of said housing; and an elongate axle shaft rotatably mounts said first and second ends of said scrubbing member to said arm portions of said housing said axle shaft having a pair of opposite ends, wherein said motor has a rotating shaft having a pair of opposite ends, one of said ends of said rotating shaft of said motor being extended in said interior space of said housing in a direction towards said first arm portion another of said ends of said rotating shaft of said motor being extending in said interior space of said housing in a direction towards said second arm portion of said housing, wherein a first set of gears operatively connects said one end of said rotating shaft of said motor to said one end of said axle shaft, wherein a second set of gears operatively connects said another end of said rotating shaft of said motor to said another end of said axle shaft, said first and second sets of gears operatively connecting said rotating shaft of said motor to said axle shaft such that rotation of said rotating shaft by said motor rotates said axle shaft.

2. The body scrubbing device of claim 1, wherein said back of said main portion has a pair of suction cups for detachably attaching said back of said main portion to the surface.

3. The body scrubbing device of claim 1, wherein said first and second ends of said scrubbing member each have a center, wherein said longitudinal axis of said scrubbing member is extended through said centers of said first and second ends of said scrubbing member, and wherein said first and second ends of said scrubbing member are rotatably mounted to the associated arm portion of said housing at said centers of said first and second ends of said scrubbing member to permit free rotation of said scrubbing member about said longitudinal axis of said scrubbing member.

4. The body scrubbing device of claim 1, wherein said first and second sets of said gears each comprises a primary gear, a rotation gear and an axle gear, said primary gear being attached to the associated end of said rotating shaft, said axle gear being attached to the associated end of said axle shaft, said rotation gear being interposed between said primary gear and said axle gear and engaging both said primary gear and said axle gear such that rotation of one of said gears results in rotation of the other gears of the set of gears.

5. The body scrubbing device of claim 1, further comprising a power source being electrically connected to said motor.

6. The body scrubbing device of claim 5, wherein said power source comprises a plurality of batteries provided in a second compartment in said interior of said housing in said main portion of said housing.

7. The body scrubbing device of claim 1, wherein said axle shaft extends through said first and second ends of said scrubbing member along said longitudinal axis of said scrubbing member such that one of said ends of said axle shaft extends from said first end of said scrubbing member and another of said ends of said axle shaft extends from said second end of said scrubbing member, said one end of said axle shaft being extended into said first arm portion of said housing and said another end of said axle shaft being extended into said second arm portion of said housing to permit free rotation of said axle shaft and said scrubbing member about said longitudinal axis of said scrubbing member.

8. A body scrubbing device, comprising:

a housing being generally U-shaped and having an interior, a spaced apart pair of arm portions and a main portion connecting said arm portions of said housing together;

wherein said arm portions of said housing have a generally rectangular cross section, wherein said main portion of said housing has a generally rectangular cross section;

said main portion of said housing having a front and a back, said arm portions of said housing being outwardly extended from said front of said main portion;

said back of said main portion being attachable to a surface, said back of said main portion having a pair of suction cups for detachably attaching said back of said main portion to the surface;

a scrubbing member being positioned between said arm portions of said housing;

said scrubbing member being generally cylindrical and having generally circular opposite first and second ends, and a longitudinal axis extending between said first and second ends of said scrubbing member;

said first and second ends of said scrubbing member each having a center, said longitudinal axis of said scrubbing member extending through said centers of said first and second ends of said scrubbing member;

said first end of said scrubbing member being rotatably mounted to a first of said arm portions of said housing, said second end of said scrubbing member being rotatably mounted to a second of said arm portions of said housing, said first and second ends of said scrubbing member being rotatably mounted to the associated arm portion of said housing at said centers of said first and second ends of said scrubbing member to permit free rotation of said scrubbing member about said longitudinal axis of said scrubbing member;

wherein an elongate axle shaft rotatably mounts said first and second ends of said scrubbing member to said arm portions of said housing, said axle shaft having a pair of opposite ends, said axle shaft extending through said first and second ends of said scrubbing member along said longitudinal axis of said scrubbing member such that one of said ends of said axle shaft extends from said first end of said scrubbing member and another of said ends of said axle shaft extends from said second end of said scrubbing member;

said one end of said axle shaft being extended into said first arm portion of said housing and said another end of said axle shaft being extended into said second arm portion of said housing to permit free rotation of said axle shaft and said scrubbing member about said longitudinal axis of said scrubbing member;

a motor for rotating said scrubbing member about said longitudinal axis of said scrubbing member, said motor being provided in said interior space of said housing in a first compartment in said main portion of said housing;

said motor having a rotating shaft having a pair of opposite ends, one of said ends of said rotating shaft of said motor being extended in said interior space of said housing in a direction towards said first arm portion, another of said ends of said rotating shaft of said motor being extending in said interior space of said housing in a direction towards said second arm portion of said housing;

a first set of gears operatively connecting said one end of said rotating shaft of said motor to said one end of said axle shaft, a second set of gears operatively connecting said another end of said rotating shaft of said motor to said another end of said axle shaft, said first and second sets of gears operatively connecting said rotating shaft of said motor to said axle shaft such that rotation of said rotating shaft by said motor rotates said axle shaft;

wherein said first and second sets of said gears each comprises a primary gear, a rotation gear and an axle gear, said primary gear being attached to the associated end of said rotating shaft, said axle gear being attached to the associated end of said axle shaft, said rotation gear being interposed between said primary gear and said axle gear and engaging both said primary gear and said axle gear such that rotation of one of said gears results in rotation of the other gears of the set of gears; and a power source being electrically connected to said motor, wherein said power source comprises a plurality of batteries provided in a second compartment in said interior of said housing in said main portion of said housing.

* * * * *